United States Patent [19]

Yamamura et al.

[11] Patent Number: 5,022,184

[45] Date of Patent: Jun. 11, 1991

[54] MANUAL WINDOW REGULATOR

[75] Inventors: Kengo Yamamura, Inasa; Tutomu Saito, Toyohashi; Youji Higuchi, Okazaki, all of Japan

[73] Assignee: ASMO Co., Ltd., Shizuoka, Japan

[21] Appl. No.: 341,557

[22] Filed: Apr. 21, 1989

[30] Foreign Application Priority Data

Apr. 25, 1988 [JP] Japan ..... 63-103401

[51] Int. Cl.[5] ..... E05F 11/48

[52] U.S. Cl. ..... 49/352; 49/362

[58] Field of Search ..... 49/352, 360, 362

[56] References Cited

U.S. PATENT DOCUMENTS

| | | | |
|---|---|---|---|
| 1,997,646 | 4/1935 | Miller | 49/352 |
| 4,222,202 | 9/1980 | Pigeon | 49/352 |
| 4,263,748 | 4/1981 | Kazewych | 49/352 |
| 4,403,450 | 9/1983 | Ishii | 49/352 |
| 4,660,325 | 4/1987 | Bauer et al. | 49/352 |
| 4,665,651 | 5/1987 | Fukumoto et al. | 49/352 |
| 4,744,172 | 5/1988 | Miyauchi | 49/352 X |
| 4,878,391 | 11/1989 | Komatsu et al. | 49/352 X |

FOREIGN PATENT DOCUMENTS

| | | | |
|---|---|---|---|
| 2217784 | 10/1979 | Fed. Rep. of Germany | 49/352 |
| 2520466 | 7/1983 | France | 49/352 |
| 698078 | 11/1965 | Italy | 49/352 |
| 25933 | 7/1978 | Japan . | |
| 54-151226 | 11/1979 | Japan . | |
| 68284 | 5/1985 | Japan . | |
| 286485 | 12/1986 | Japan . | |
| 222816 | 10/1924 | United Kingdom | 49/352 |
| 631131 | 10/1949 | United Kingdom | 49/352 |

*Primary Examiner*—Gary L. Smith
*Assistant Examiner*—Michael J. Milano
*Attorney, Agent, or Firm*—Oliff & Berridge

[57] ABSTRACT

A manual window regulator in which a pinion rotatably carried by a window glass and driven by a manual handle is held in engagement with a rack which is fixed to extend in the direction of movement of the window glass, so that a manual rotation of the handle causes the pinion to roll along the rack in meshing engagement therewith so as to drive the window glass thereby opening and closing a window. The transmission of rotation from the handle to the pinion is effected through a tape stretched between a drive gear rotationally driven by the handle and driven gear coaxially fixed to the pinion. The rack and the pinion are usable also as the parts of a power window regulator. The manual window regulator therefore can be easily converted into a power window regulator by using an electric motor for driving the pinion in place of the unit including the handle, the drive gear and the tape.

16 Claims, 19 Drawing Sheets

MANUAL WINDOW REGULATOR

BACKGROUND OF THE INVENTION

1. Field of the Invention

The present invention relates to a manual window regulator, particularly to a manual window regulator for vehicles.

2. Description of the Related Art

Various types of manual window regulators have been proposed and put into practical use. On the other hand, nowadays, power window regulators which drive the window glass by the power of a motor have become popular. In general, it is desirable that a manual window regulator and a power window regulator have substantially the same basic construction so that either one of these two types of window regulator may be obtained through a simple replacement of some of the parts.

A window regulator which meets such a requirement is disclosed in Japanese Utility Model Publication No. 53-25933. This window regulator is designed to be easily changed to either a wire-driven power window regulator or a manual window regulator. When assembled as a manual window regulator, the window regulator is provided with a handle to which is fixed a pinion meshing with a toothed wheel capable of winding and unwinding a wire thereby driving a window. In contrast, when the window regulator is intended for use as a power window regulator, the abovementioned pinion is driven by a motor through a worm reduction gear including a worm wheel coaxially fixed to the pinion.

This window regulator, assembled as a power window regulator, can be easily modified into a manual window regulator. In the power window regulator configuration, the motor is fixed to a stationary part on the door so as to transmit the driving power to the window glass which is to be moved. The transmission of power is conducted through a transmission mechanism which employs a large number of parts and, hence, occupies a considerably large portion of the space inside the door panel.

To remedy this problem, in recent years, a so-called self-drive type power window regulator has been proposed as in Japanese Utility Model Laid-Open Publication No. 60-68282 and 60-286485, in which a driving motor having a pinion is mounted on the window glass with the pinion meshing with a rack which is installed to extend in the direction of movement of the window glass, whereby the window glass is propelled directly by the power of the motor.

This type of power window regulator is advantageous in that the number of parts is reduced as compared with an ordinary power window. In addition, the space inside the door panel is not substantially occupied because only the rack is fixedly mounted in this space.

This type of power window regulator, however, incurs the following problem when it is to be modified into a manual window regulator. Namely, a mechanism which is entirely different from that in an ordinary manual window regulator is required for the purpose of transmitting the torque of the handle to the pinion on the motor which moves, for example, up and down together with the window.

Thus, modification of the self-driving type power window into a manual window regulator is not easy.

SUMMARY OF THE INVENTION

Accordingly, an object of the present invention is to make it possible to easily modify a rack-pinion type selfdriving power window regulator into a manual window regulator to comply with the requirements of, for example, a user, through a simple replacement of parts and without impairing the advantage inherent in the self-driving power window regulator.

To this end, according to the present invention, there is provided a manual window regulator for driving a window glass by a manual rotational force exerted on a handle to thereby open and close a window, consisting of a rack fixed to extend in the direction of movement of the window glass, a pinion rotatably carried by the window glass and held in meshing engagement with the rack, a driving device rotatable in accordance with the rotation of the handle, a driven device rotatable as a unit with the pinion, a loop-type transmission element for transmitting the rotation of the driving device to the driven device, and a guide device for guiding the pinion to enable the pinion to move along the rack in meshing engagement with the rack.

In operation, a manual rotation of the handle causes the driving device to rotate, which in turn causes the driven device to rotate as a result of a movement of the loop-shaped transmission element. The rotation of the driven device causes a rotation of the pinion so that the pinion rolls on the rack in meshing engagement therewith while being guided by the guide device. Since the rack is fixed to extend in the direction of movement of the window glass while the pinion is supported on the window glass, the window glass is driven in accordance with the movement of the pinion, thus opening and closing the window.

The rack, the pinion and the guide device are commonly usable in both the self-driving power window regulator and the manual window regulator. Therefore, a manual window regulator can be easily changed into a self-driving power window regulator by mounting a driving motor on the window glass and fixing the pinion to the motor shaft.

Conversely, a manual window regulator can be easily obtained by using a manually rotatable handle capable of rotating the pinion by means of a loop type transmission, in place of the driving motor.

Thus, the present invention provides a manual window regulator employing a rack and a pinion which are usable commonly as parts of a self-driving power window regulator, the pinion being manually rotated through a loop type transmission by a handle. The manual window regulator, having such structural features, therefore, can be easily changed into a self-driving window regulator simply by a substitution of a driving motor for the manual driving apparatus.

The driving device and the driven device may be gears or grooved pulleys, while any suitable member drivingly engageable with the driving and driven devices, such as a tape having perforations at a regular pitch, a timing belt or the like, can be suitably used as the power transmission element.

Since the driven device is moved along the rack together with the pinion, and the power transmission element has a constant length, it is necessary to provide a method to maintain tension in the power transmission element regardless of the movement of the driven device. Also the assembly of the manual window regulator can be very much facilitated if the rack and the handle can be attached to a common base.

When the power transmission element is arranged to go around the driving and driven devices in the form of a loop, the transmission element may slacken or become loose as a result of the movement of the driven device along the rack, causing a change in the distance between the driving and driven devices. In such a case, one method which can be incorporated to maintain tension in the transmission is to reduce the distance between opposing runs of the loop-type transmission element to remove any slack.

An alternative method is to use a quadrilateral link mechanism provided between the driving and driven devices with the transmission element going around the four apexes of the link mechanism so that the length of path of the transmission element is maintained constant regardless of the change in the distance between the driving and driven devices caused by the movement of the driven device.

DESCRIPTION OF THE PREFERRED EMBODIMENTS

Preferred embodiments of the manual window regulator of the present invention, applied to a door window of an automobile, will be described hereinafter with reference to the accompanying drawings.

Figure 1:
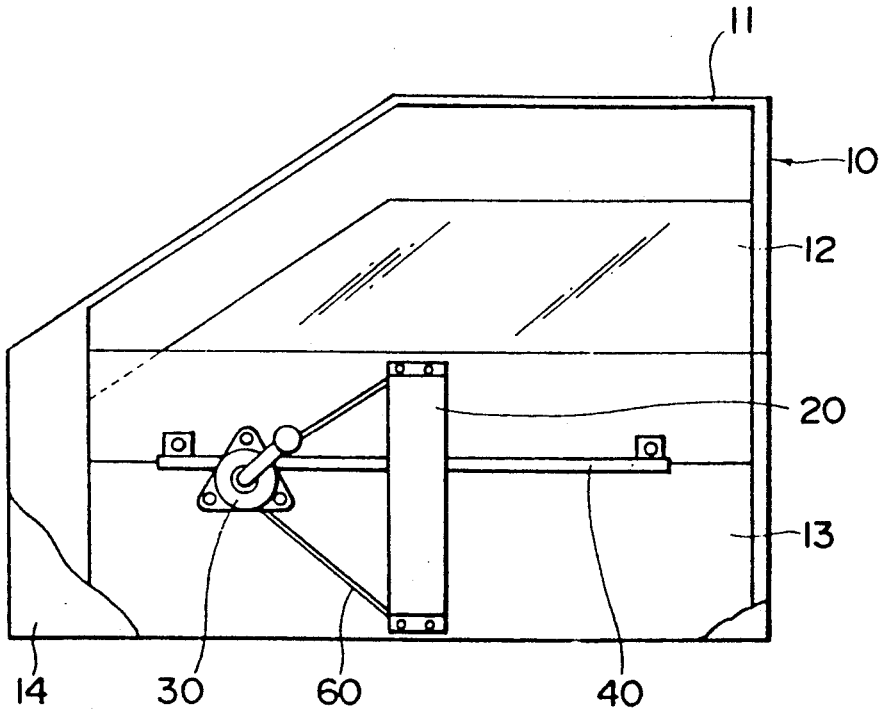
FIG. 1 is a schematic illustration of the whole of a manual window regulator in accordance with the present invention.

As can be seen from FIG. 1, the door 10 of an automobile has a door frame 11, an outer panel 13 and an inner panel 14.

A window glass 12 to be operated by the manual window regulator of the invention, is mounted inside the door 10 for vertical movement along window guides. A rack bracket 20 having a rack 22 (not shown in FIG. 1) is fixed in the space between the outer panel 13 and the inner panel 14 such that the rack 22 extends in the direction of the movement of the door glass 12. A handle device 30 for mounting a window regulator handle 32 is fixed to the inside of the inner panel 14 adjacent to the outer panel 13.

A lift arm bracket 40 is fixed to both breadthwise ends of the window glass 12 at the lower end of the latter. A gear box 50 (not shown in FIG. 1) for rotatably supporting a later-mentioned gear is fixed to the lift arm bracket 40.

Figure 2:
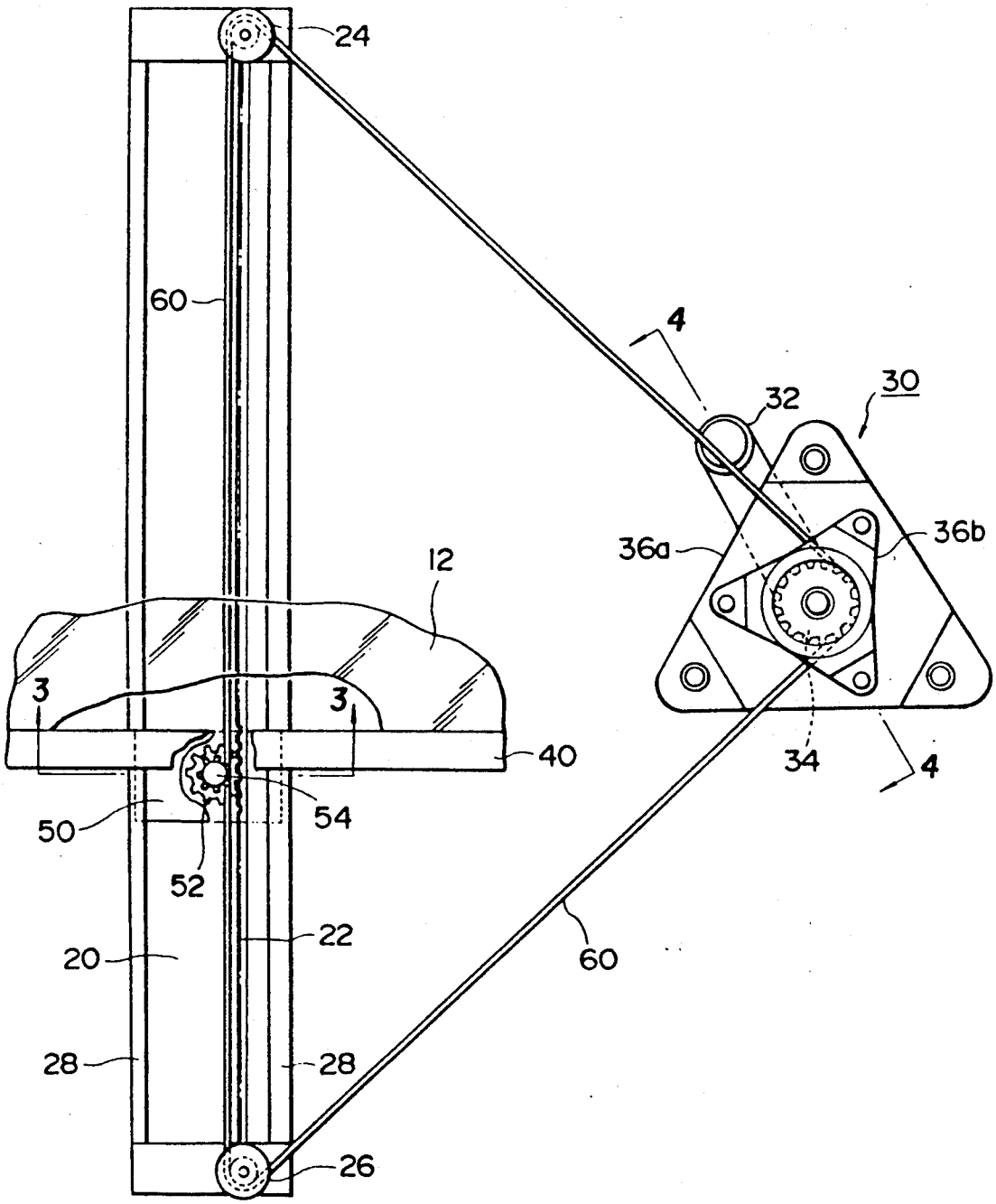
FIG. 2 is a schematic illustration of a first embodiment of the present invention showing essential portions thereof in a cut away side elevation as viewed from the exterior of an automobile.

FIG. 2 shows schematically the arrangement of essential parts such as the rack 22, the handle device 30, the pinion 52 in the gear box 50, in a cut away side elevation as viewed from the exterior of the automobile. The pinion 52 is arranged in meshing engagement with the rack 22. The window regulator further has a drive gear 34 as an example of a driving rotary member which is rotated in accordance with rotation of the handle 32 of the handle device 30, idle pulleys 24 and 26 which are rotatably supported by the upper and lower ends of the rack bracket 20, and a driven gear 54 which is formed coaxially with the pinion gear 52 and which is used as a driven rotary member of the window regulator of the invention. A loop-shaped tape 60, serving as a torque transmission member in the window regulator of the present invention, is disposed to engage with gear 34 and to gear 54 and go around the pulleys 24, 26. The tape 60 has perforations 60*a* (not shown in FIG. 2) at regular intervals.

Figure 3:
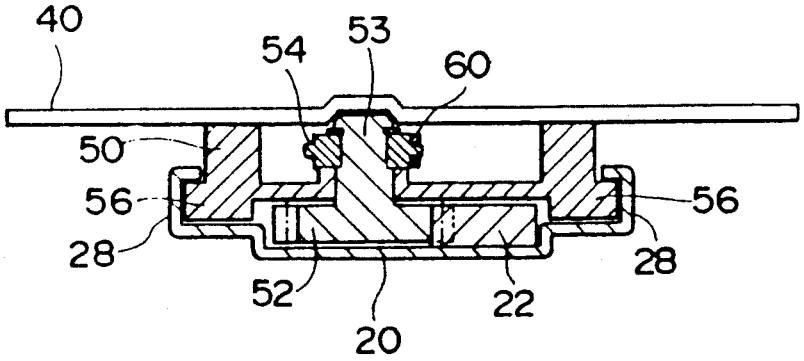
FIG. 3 is a sectional view taken along the line A-A of FIG. 2.

FIG. 3 illustrates a sectional view taken along the line A-A of FIG. 2. The gear box 50 is fixed to the lift arm bracket 40. The gear box 50 rotatably carries the pinion 52 which meshes with the rack 22 as illustrated. The driven gear 54 mentioned before is fixed to the shaft 53 of the pinion 52. In order to enable the gear box 50 to vertically move up and down together with the door glass 12 while keeping meshing engagement between the rack 22 and the pinion 20, the gear box 50 is provided at both its breadthwise ends with projections 56, 56 which are slidably received in channel-shaped or C-shaped guide members 28, 28 formed on the rack bracket 20.

Figure 5:
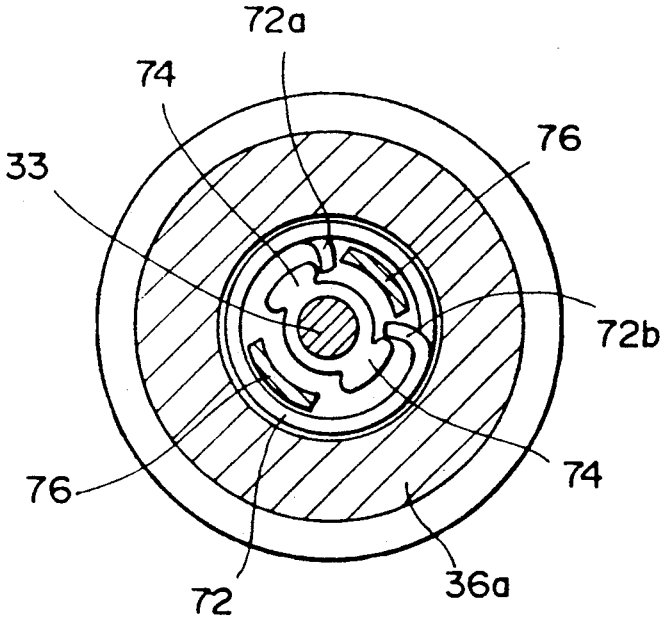
FIG. 5 is a view taken in the direction of the arrows D-D of FIG. 4.
Figure 6:
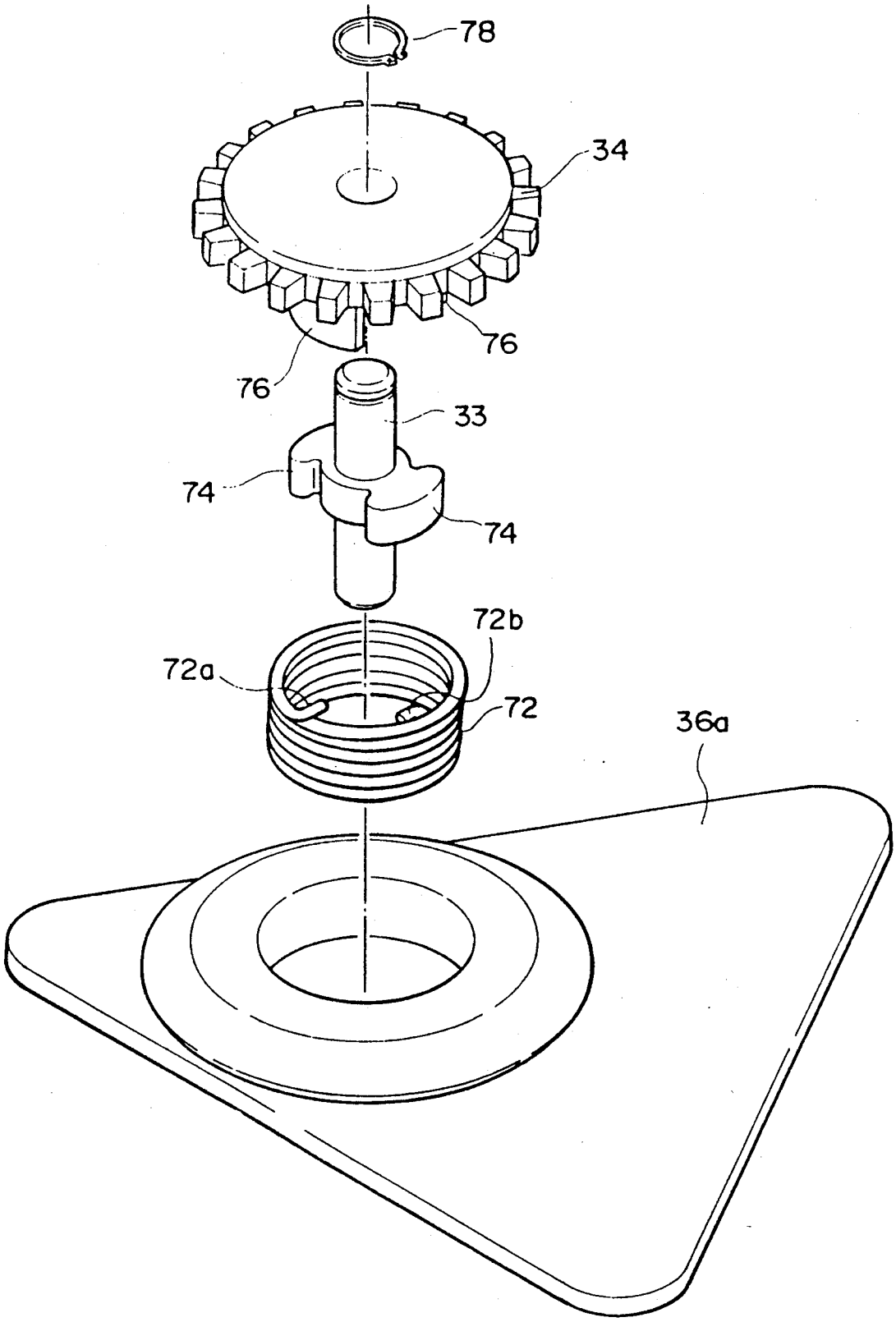
FIG. 6 is an exploded perspective view of a clutch mechanism.

The construction of the handle device 30 will explained in more detail with reference to FIGS. 4 to 6.

Figure 4:
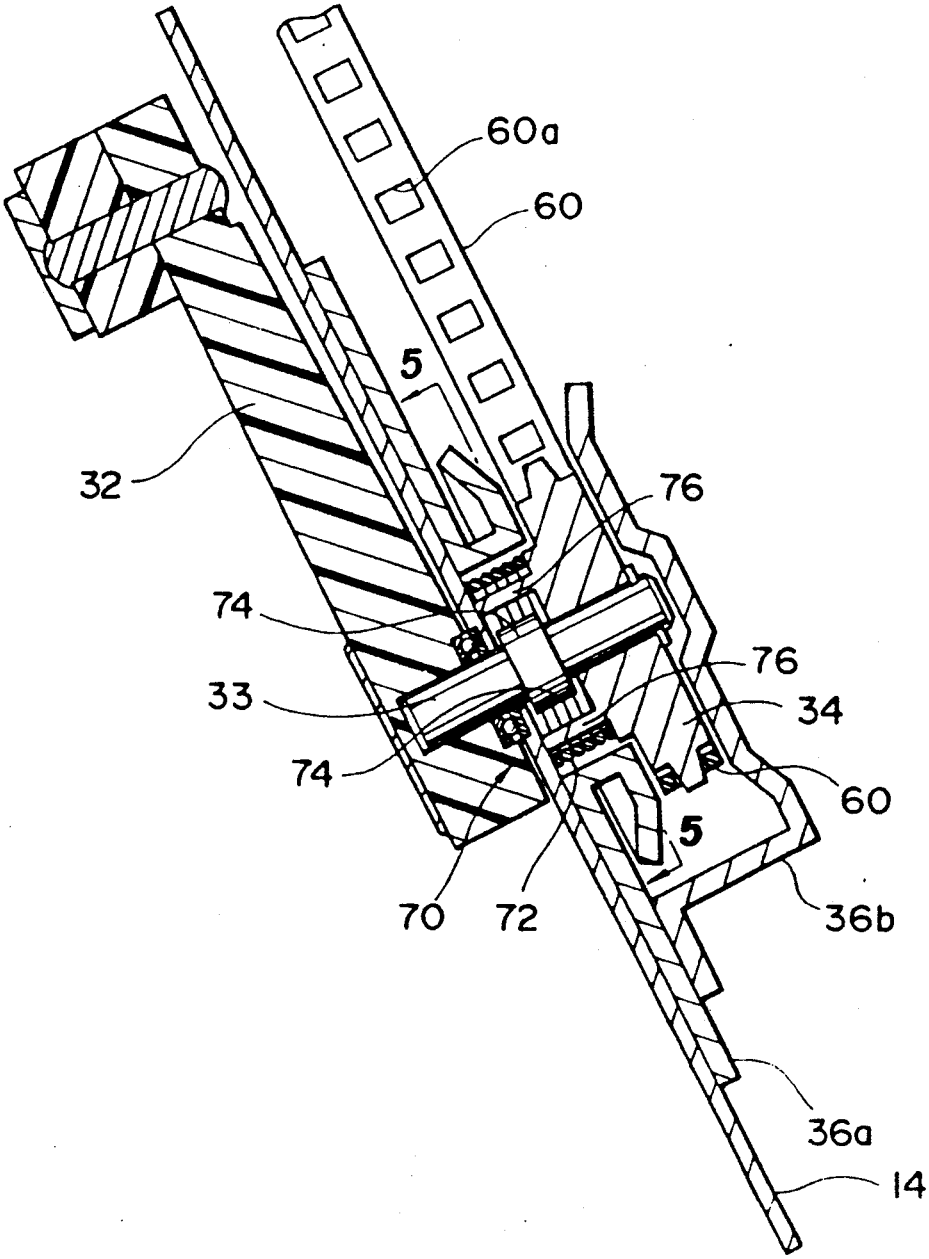
FIG. 4 is a sectional view taken along the line B-B of FIG. 2.

Referring first to FIG. 4 which is a sectional view taken along the line B-B of FIG. 2, the handle 32 is fixed to one end of a handle shaft 33 to the other end of which is fixed the drive gear 34. The handle shaft 33 is rotatably supported, through a clutch mechanism 70, by a lower casing 36*a* which is fixed to the inner panel 14 of the door. Although not shown, a door-trim board covers the exposed surface of the inner panel 14 adjacent to the handle 32.

The construction of the clutch mechanism 70 will be described with reference to FIG. 5 which is a view taken in the direction of arrows D-D of FIG. 4 and also to FIG. 6 which is an exploded perspective view of the handle device 30.

The clutch mechanism 70 encased in the lower casing 36*a* includes a coiled spring 72 having both ends 72*a*, 72*b* bent radially inward, a handle shaft 33 with two lugs 74, 74 projecting radially outwards, and projection claws 76, 76 fixed to the drive gear 34 and disposed between the two lugs 74, 74. These members are assembled in the lower casing 36*a* in a sequence which is illustrated in FIG. 6. After setting of the drive gear 34 over the handle shaft 33, a C-ring 78 retainer is fitted on the upper end of the handle shaft 33 and then the upper side of the handle shaft 33 is encased by the upper casing 36*b*.

The function of this clutch mechanism 70 is as follows. A torque manually exerted on the handle 32 is transmitted to either one of the bent ends 72*a* and 72*b* of the coiled spring 74 through one of the lugs 74, in such a manner as to wind and tighten the coiled spring 72. This causes the coiled spring 72 to radially contract thereby releasing a braking effect as described below so as to enable the drive gear 34 to rotate so as to cause the door glass to move up and down. On the other hand, moving the door glass up and down by a manual force directly exerted on the door glass is prevented because the spring 72 is expanded radially to produce a braking or locking effect, due to the rotation of either end 72*a* or 72*b* thereof caused by the projecting claw 76 as a result of rotation of the drive gear 34. The clutch mechanism 70 may be arranged to act between the pinion and the drive gear, as will be explained later.

In operation, a manual rotating force exerted on the handle 32 of the handle device 30 causes the handle shaft 33 to rotate. In this state, the clutch mechanism 70 operates to release the braking effect as described above, so that the drive gear 34 is rotated in accordance with the rotation of the handle shaft 33. The perforations 60*a* of the tape 60 successively engage with the teeth on the drive gear 34 so that the tape 60 is driven as a result of the rotation of the drive gear 34.

The tape 60 having an endless loop-like form is made to go around the drive gear 34, idle pulleys 24, 26 on the upper and lower ends of the rack 22 and the driven gear 54 so as to run along a substantially triangular path.

The driven gear 54 is disposed at an intermediate portion of the straight vertical path of the tape 60 between the idle pulleys 24 and 26, with its teeth engaging with perforations 60*a* in the tape 60, so that the rotation of the drive gear 34, caused by the rotation of the handle 32, is transmitted to the driven gear 54.

The driven gear 54 is arranged coaxially and integrally with the pinion 52 which meshes with the rack 22. As a consequence, the pinion 52 is rotated about its own axis so that it rolls up and down along the rack 22.

The pinion 52 is supported by the gear box 50 which is fixed to the lift arm bracket 40 so that the window glass 12 to which the lift arm bracket 40 is fixed is driven up and down.

As will be understood from the foregoing description, the torque exerted on the handle 32 is transmitted to the moving pinion 52 through the tape 60 which has a portion extended between the idle pulleys 24 and 26 in parallel with the path of movement of the pinion 52, and this portion of the tape 60 drivingly engages with the driven gear 54 which is coaxial and integral with the pinion 52. It is therefore possible to rotatingly drive the pinion gear 52 without changing the path of run of the tape 60.

In this driving system, the manual force to be exerted on the handle 32 for driving the door window up and down can be varied by changing the numbers of teeth on the drive gear 34, driven gear 54 and the pinion gear 52. Thus, the manual window regulator of the invention may be constructed in such a manner as to enable the door window to be driven up and down with a force smaller than that required in a conventional manual window regulator, if the number of teeth is suitably selected.

The rack 22 used as the basic constituent of the manual window regulator of this embodiment may be used also in a self-driving power window. Thus, the manual window regulator of the described embodiment can easily be modified into a self-driving power window by making use of the rack 22. Namely, such a modification can be accomplished by removing the handle device 30, the handle 32 and the tape 60, and mounting a power source such as a motor on the lift arm bracket 40 such that the output of the motor is transmitted to the pinion 52 which meshes with the rack 22.

Figure 7:
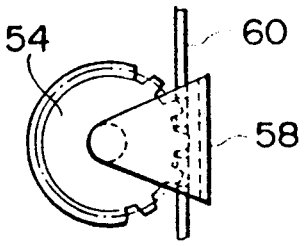
FIG. 7 is a schematic illustration of a modification of the first embodiment, in which a driven gear is provided with a guide for preventing a tape from coming off.

In the first embodiment as described, it is possible to ensure the safe operation of the window regulator by arranging the components so as to increase the number of teeth of the driven gear 54 that actually engage with the tape 60. To achieve this, the idle pulleys 24 and 26 may be laterally offset as indicated by the arrows in FIG. 2. An excessive offset of the pulleys, however, should be avoided because such a large offset causes a large tension to be applied to the tape 60 when the pinion 52 approaches either end of the rack 22, with the result that the feel of the handle operation becomes undesirably. When the portion of the tape 60 between the idle pulleys 24 and 26 is set substantially straight, the driven gear 54 tends to come off the tape 60 because the number of teeth of the driven gear 54 actually engaging with the tape 60 is rather small. In order to overcome such a problem, it is advisable to provide a guide 58 as shown in FIG. 7 which guides the tape 60 to enable the tape 60 to run always in meshing engagement with the driven gear 54.

Figure 8:
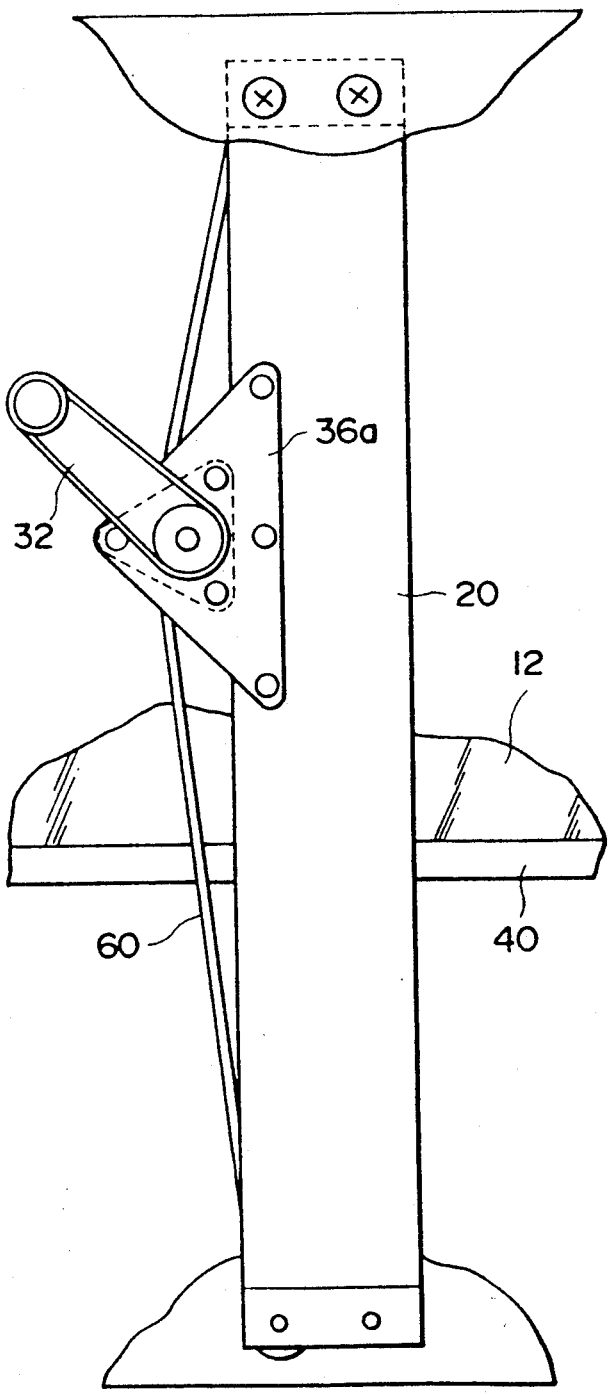
FIG. 8 is a schematic illustration of a second embodiment of the present invention showing essential portions thereof in a cut away side elevation as viewed from the interior of a passenger's compartment of an automobile.
Figure 9:
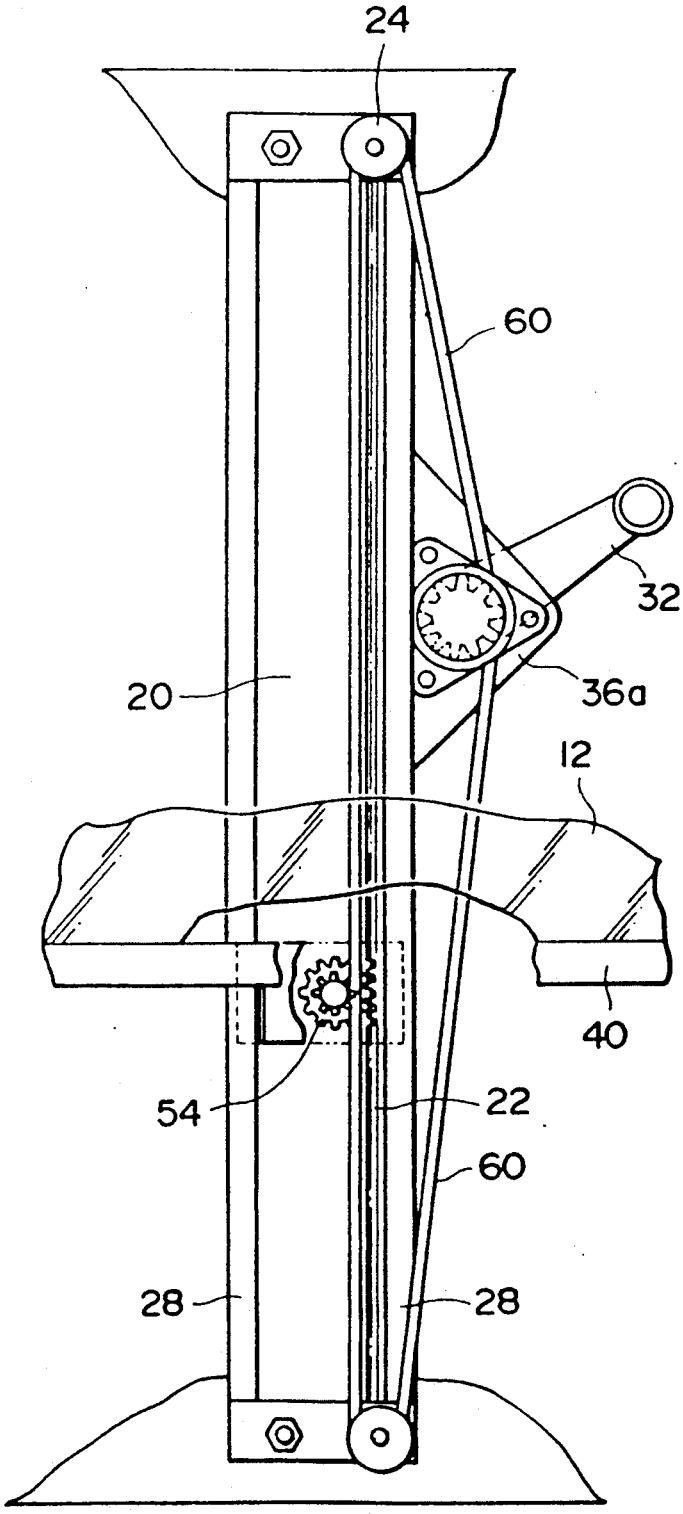
FIG. 9 is a schematic illustration of the second embodiment of the present invention showing essential portions thereof in a cut away side elevation as viewed from the exterior, of the automobile.

A second embodiment which will be described hereinafter relies substantially on the same driving principle as the first embodiment, but is modified to provide a simpler assembly. More specifically, as will be seen from FIGS. 8 and 9 which are side elevations as viewed from the interior and exterior of the passenger compartment respectively, the lower casing 36*a* of the handle device 30 is fixed to the rack bracket 20 by use of, for example, screws. As a result, the handle device 30 is disposed in close proximity to the rack 22.

In this second embodiment, the door window 12 is driven up and down in the same manner as the first embodiment. It will be seen, however, that the mounting of the manual window regulator on the door panel 10 is very much simplified. More specifically, since the rack bracket 20 and the lower casing 36*a* of the handle device 30 are coupled directly, the drive gear 34 and the idle pulleys 24, 26 around which the tape 60 runs are supported on a common base, thus facilitating the mounting of the tape 60. Thus, the tape 60 can be properly set on the manual window regulator before the manual window regulator is actually mounted on the door of an automobile, thus facilitating the assembly of the manual window regulator.

Figure 10:
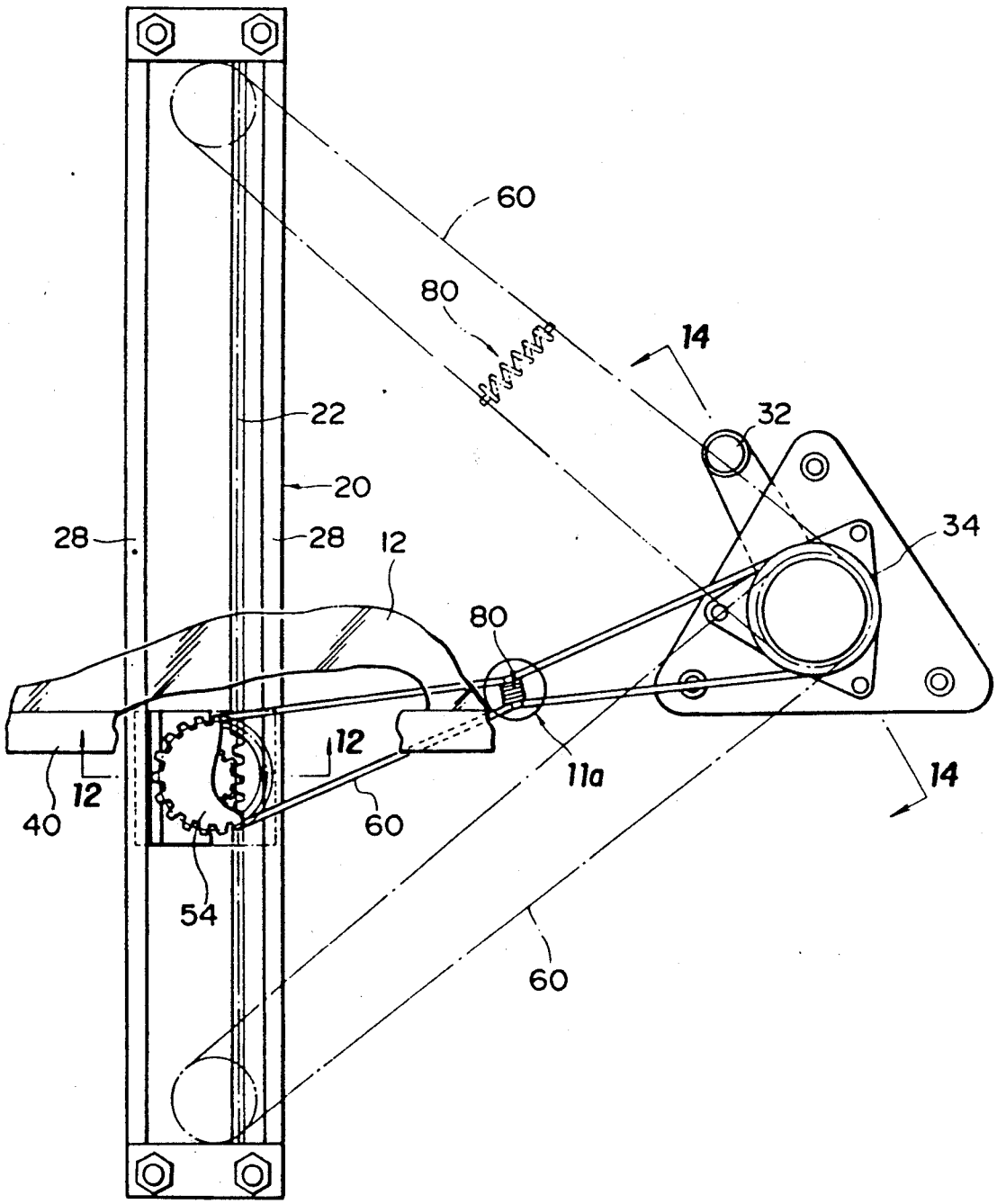
FIG. 10 is a schematic illustration of a third embodiment of the present invention showing essential portions thereof in a cut away side elevation as viewed from the exterior of the automobile.

A third embodiment of the manual window regulator of the invention does not use the idle pulleys 24, 26 used in the preceding embodiments. Instead, the third embodiment employs a driven gear 54 which has a diameter greater than the diameter of the drive gear 34 used in the first embodiment, and the endless tape 60 is wrapped around the drive gear 34 and the driven gear 54 as shown in FIG. 10.

With this arrangement, the distance between the drive gear 34 and the driven gear 54 changes depending on the position of the pinion 52 on the rack 22, as will be understood from the solid line position in which the pinion 52 is on an intermediate portion of the rack 22 and the positions shown with chain lines in which the pinion 52 is either on the upper or lower end of the rack 22. This means that the length of tape 60 required also varies depending on the position of the pinion 52.

If the length of the tape 60 is made to suit the maximum distance between the drive gear 34 and the driven gear 54, the tape 60 will slacken when the distance between the drive and driven gears 34 and 54 respectively is reduced, i.e., when the pinion 52 is on the middle portion of the rack 22. With a slack tape 60 the torque cannot correctly be transmitted.

In this third embodiment, therefore, a tensioning device 80 is provided to act in such a manner as to reduce the distance between the parallel runs of the tape 60, thus tensioning the tape 60 wrapped around the drive and driven gears 34 and 54 respectively.

More specifically, as will be seen from FIG. 10, the tensioning device 80 is designed to draw the parallel runs of the tape 60 towards each other at an approximately middle portion of the path of the tape 60 between the drive gear 34 and the driven gear 54.

Figure 11A:
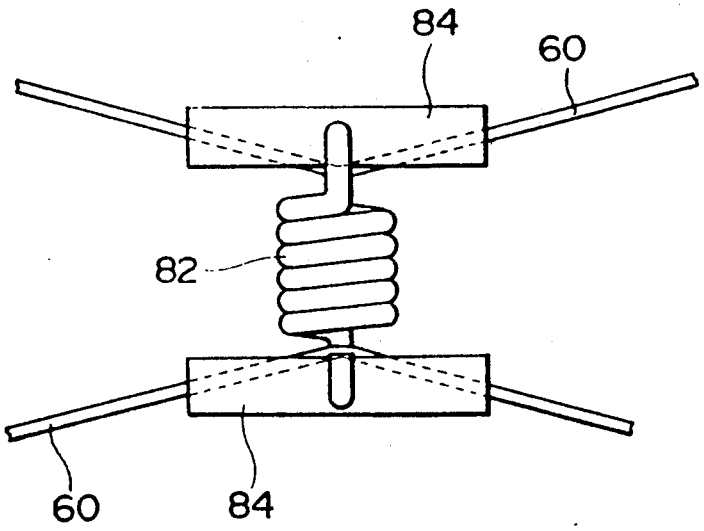
FIG. 11A is an enlarged view of a portion marked C in FIG. 10.
Figure 11B:
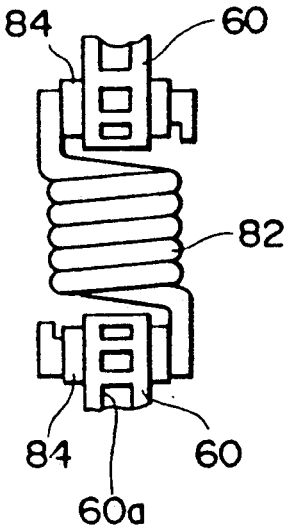
FIG. 11B is a side elevational view of the portion shown in FIG. 11A.

The construction of the tensioning device 80 will be more clearly understood from FIG. 11A which is an enlarged view of the portion marked C in FIG. 10, and FIG. 11B which is a side elevational view of the construction shown in FIG. 11A.

Namely, the tensioning device 80 includes a coiled tension spring 82 to both ends of which are attached tape guides 84 and 84 having curved surfaces. The tape guides 84 and 84 engage with respective runs of the tape 60 such that the tape runs in contact with these curved surfaces.

The coiled tension spring 82 is designed such that it is substantially unloaded when the distance between the drive and driven gears 34 and 54, is minimized, but is fully elongated, as shown in FIG. 10, when the pinion 52 has been moved to either of the ends of the rack 22. In consequence, the tape 60 can always be maintained in a state of tension regardless of the position of the pinion 52, maintaining a suitable engagement with the drive and driven gears 34 and 54.

Figure 12:
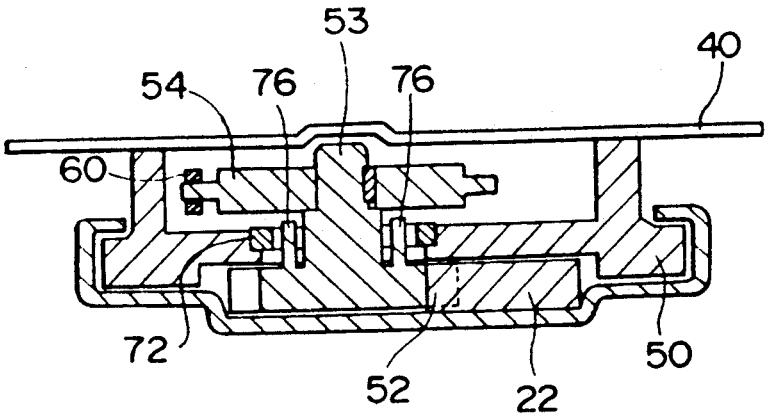
FIG. 12 is a sectional view taken along the line G-G of FIG. 10.
Figure 13:
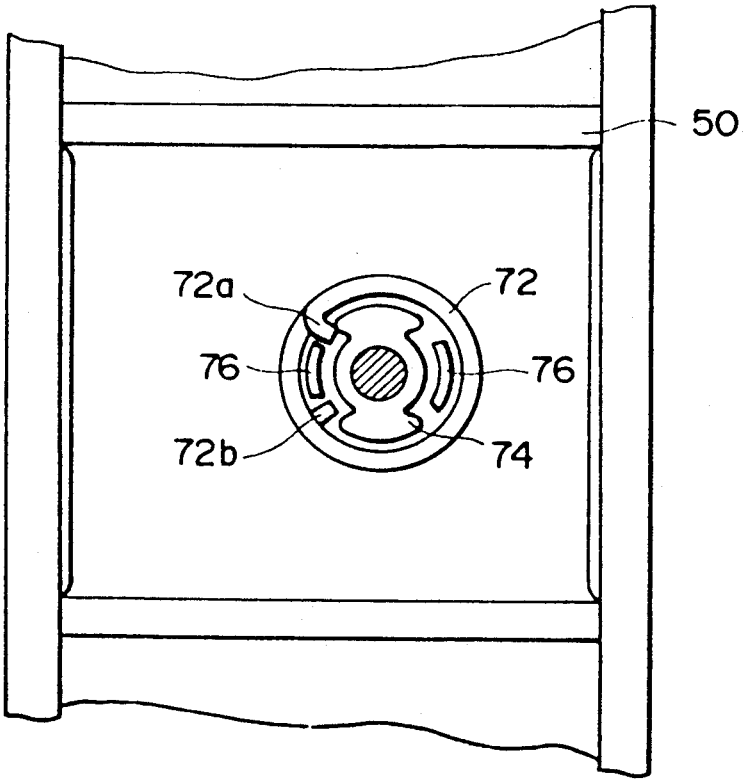
FIG. 13 is a view take in the direction of arrows F-F of FIG. 12.

In this embodiment, the clutch mechanism 70 is provided in the gear box 50 rather than in the handle device 30. This is shown in FIG. 12 which is a sectional view taken along the line G-G of FIG. 10, and in FIG. 13 which is a sectional view taken along the line F-F of FIG. 12. The aforesaid lugs 74, 74 are formed on the driven gear 54, while projection claws 76, 76 are formed on the pinion 52. These parts are disposed in the gear box 50 together with the coiled spring 72.

In operation, as the driven gear 54 is rotated, the coiled spring 72 is operated in the contracting direction by one of the lugs 74 integral with the driven gear 54, so that the braking effect which the coiled spring 72 produces is released to allow the pinion 52 to rotate, thereby moving the door glass 12 up and down. However, when a manual force is directly exerted on the door glass 12 to move the glass up or down, one of the projection claws 76 on the pinion 52 rotates so as to expand the coiled spring 72, so that the spring 72 produces a braking or locking effect, thereby locking the pinion 52 against rotation, whereby the movement of the window glass 12 by the manual force is prevented.

Figure 14:
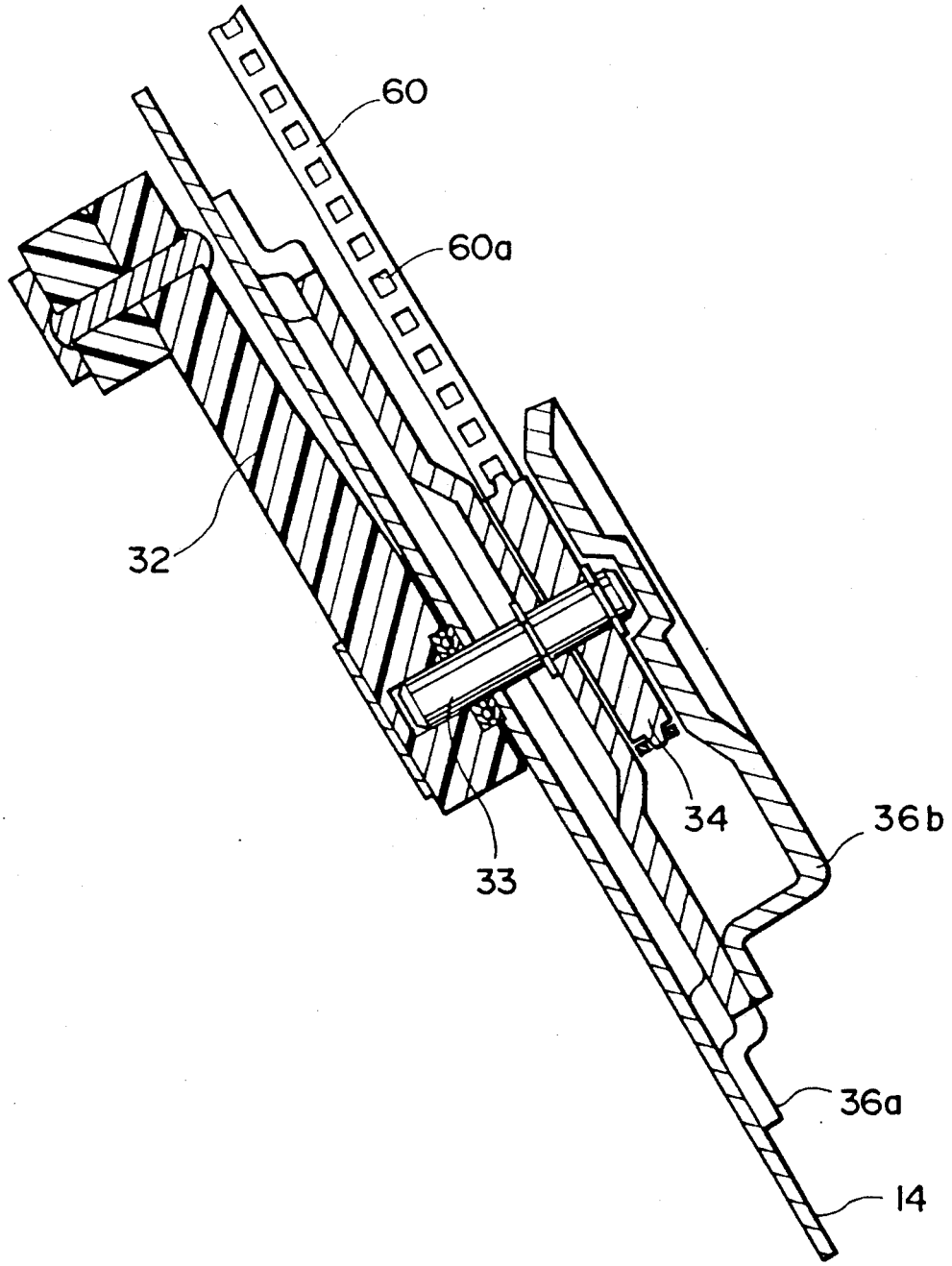
FIG. 14 is a sectional view taken along the line H-H of FIG. 10.

In this embodiment, since the clutch mechanism 70 is disposed in the gear box 50, the handle shaft 33 of the handle device 30 is directly fixed to the drive gear 34 without the intermediary of any clutch mechanism as shown in FIG. 14.

Figure 15:
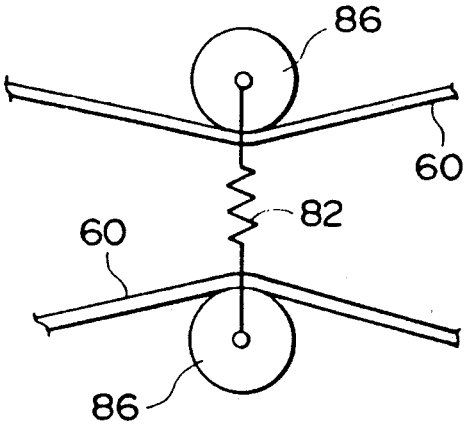
FIG. 15 is a schematic illustration of a modification of a tensioning device used in the third embodiment.

FIG. 15 shows a modification of the tensioning device used for the purpose of drawing intermediate portions of opposing runs of the tape 60 towards each other at an intermediate position between the drive and driven gears 34 and 54. In this modification, the tensioning device includes rollers 86 and 86 provided on both ends of a coiled tension spring 82 and capable of rolling on the outer surfaces of the loop-like tape 60.

It is also to be noted that the third embodiment can be modified such that the clutch mechanism is incorporated in the handle device 30.

A fourth embodiment of the present invention will be described hereinafter. The fourth embodiment is similar to the third embodiment but employs a tensioning member 90 which is different from the tensioning device 80 used in the third embodiment.

Figure 16:
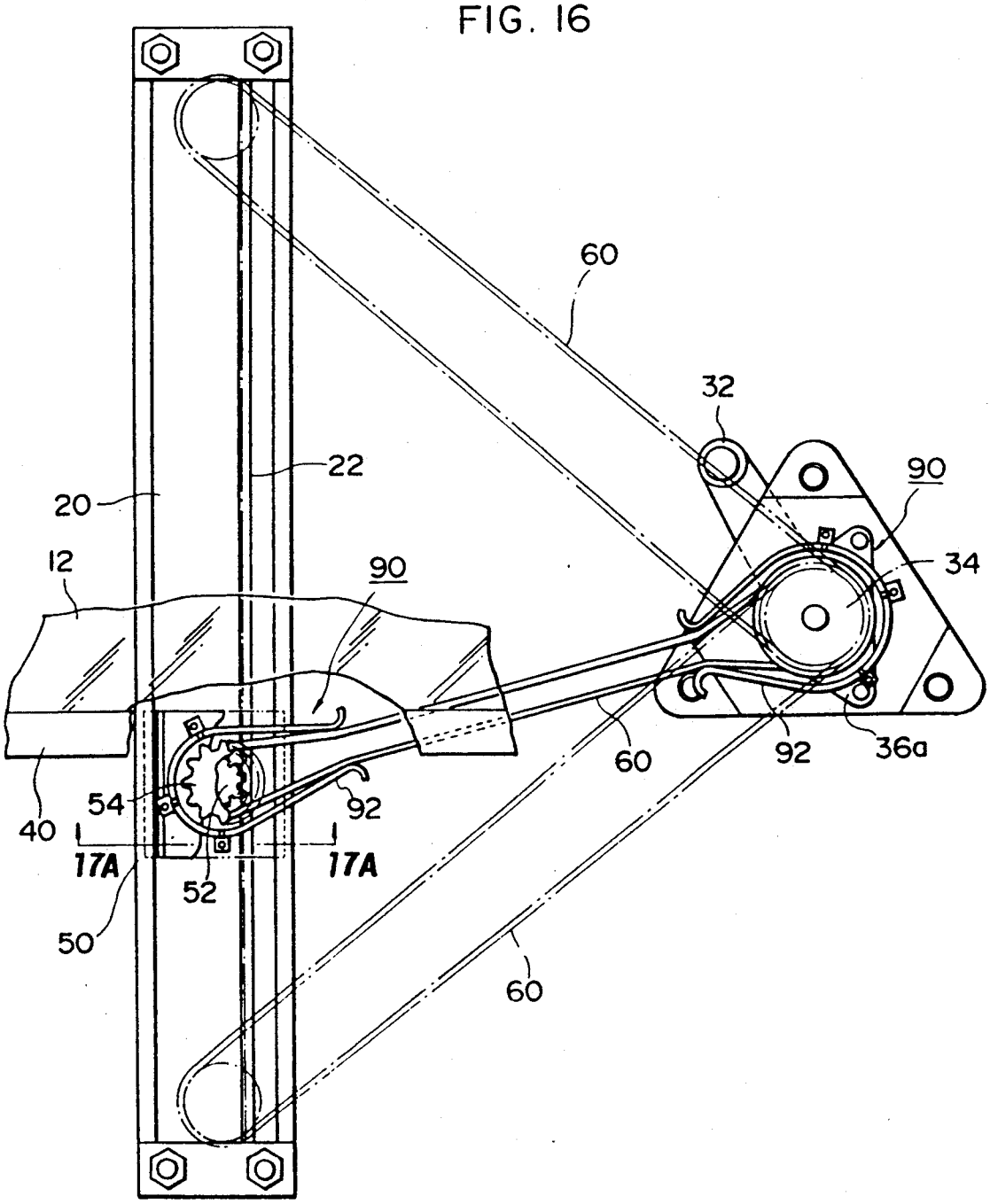
FIG. 16 is a schematic illustration of a fourth embodiment of the present invention showing essential portions thereof in a cut away side elevation as viewed from the exterior of an automobile.
Figure 17:
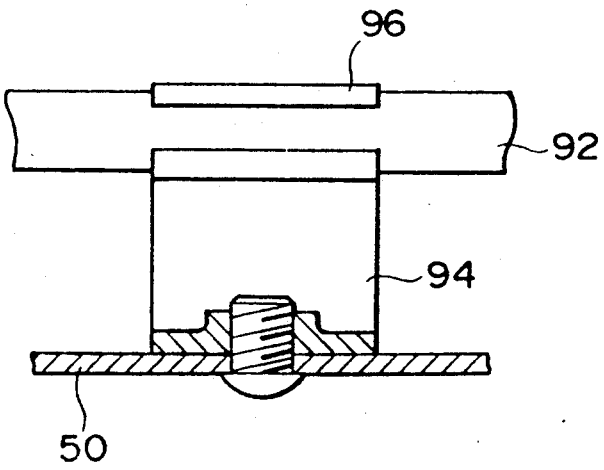
FIG. 17A is a view as viewed in the direction of arrows I-I of FIG. 16.
FIG. 17B is a side elevational view of the portion shown in FIG. 17A.
Figure 17:
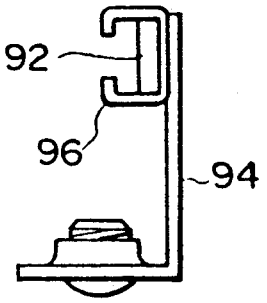

More specifically, as shown in FIG. 16, the tensioning device 90 has leaf springs 92 and 92 which are bent substantially in a U-like form and arranged to surround the drive and the driven gears 34 and 54, respectively, in such a manner as to reduce the distance between the parallel runs of the tape 60 at portions thereof near the gears 34 and 54. The leaf springs 92 and 92 are fixed to the lower casing 36*a* adjacent to the gear 34 (FIG. 14) and the gear box 50 adjacent to the gear 54 (FIG. 12), respectively. More specifically, the leaf spring 92 adjacent to the driven gear 54 is supported in a substantially C-shaped supporting member 96 fixed to one end of an angle member 94 which in turn is connected to the gear box 50, as shown in FIG. 17A which is a view as viewed in the directions of arrows I-I of FIG. 16, and FIG. 17B which is a side elevational view of the portion shown in FIG. 17A.

Figure 18:
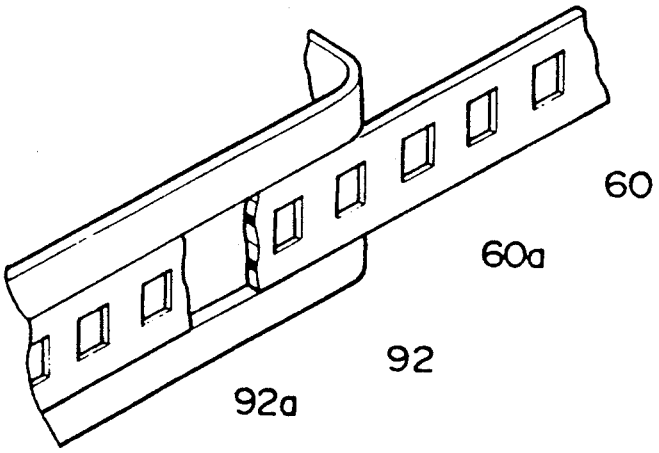
FIG. 18 is a view as viewed in the direction of an arrow J in FIG. 16.

As shown in FIG. 18 which is an illustration of the portion shown in FIG. 16 as viewed in the direction of arrow J, the ends of the leaf spring 92 are curved outwardly. A groove 92*a* of a width substantially the same as that of the tape 60 is formed at least in the surfaces of the leaf spring 92 that contact the tape 60 so that the tape 60 can run smoothly along the groove 92*a*.

The tensioning device 90 operates such that the ends of each leaf spring 92 spring towards each other to takeup any slack of the tape 60 when the pinion 52 has been moved to a position where the distance between the drive and the driven gears 34 and 54 respectively is small, thereby maintaining the tape 60 in a state of tension. However, when the pinion 52 has approached one of the ends of the rack 22, the distance between the opposing ends of each leaf spring is increased to allow for the increase in the distance between the driving and the driven gears 34 and 54 respectively, maintaining a suitable tension in the tape 60, thereby keeping the tape 60 in stable engagement with the drive and the driven gears 34 and 54 respectively.

As in the case of the third embodiment, the gear box 50 in the fourth embodiment incorporates a clutch mechanism 70 so as to prevent the door glass 12 from being moved up and down by manual force directly exerted thereon. The clutch mechanism 70 may alternatively be disposed in the handle device.

A fifth embodiment of the present invention will be described hereinafter. The fifth embodiment features an arrangement which maintains the length of the path of the tape 60 constant regardless of the position of the driven gear 54 along the rack 22.

Figure 19:
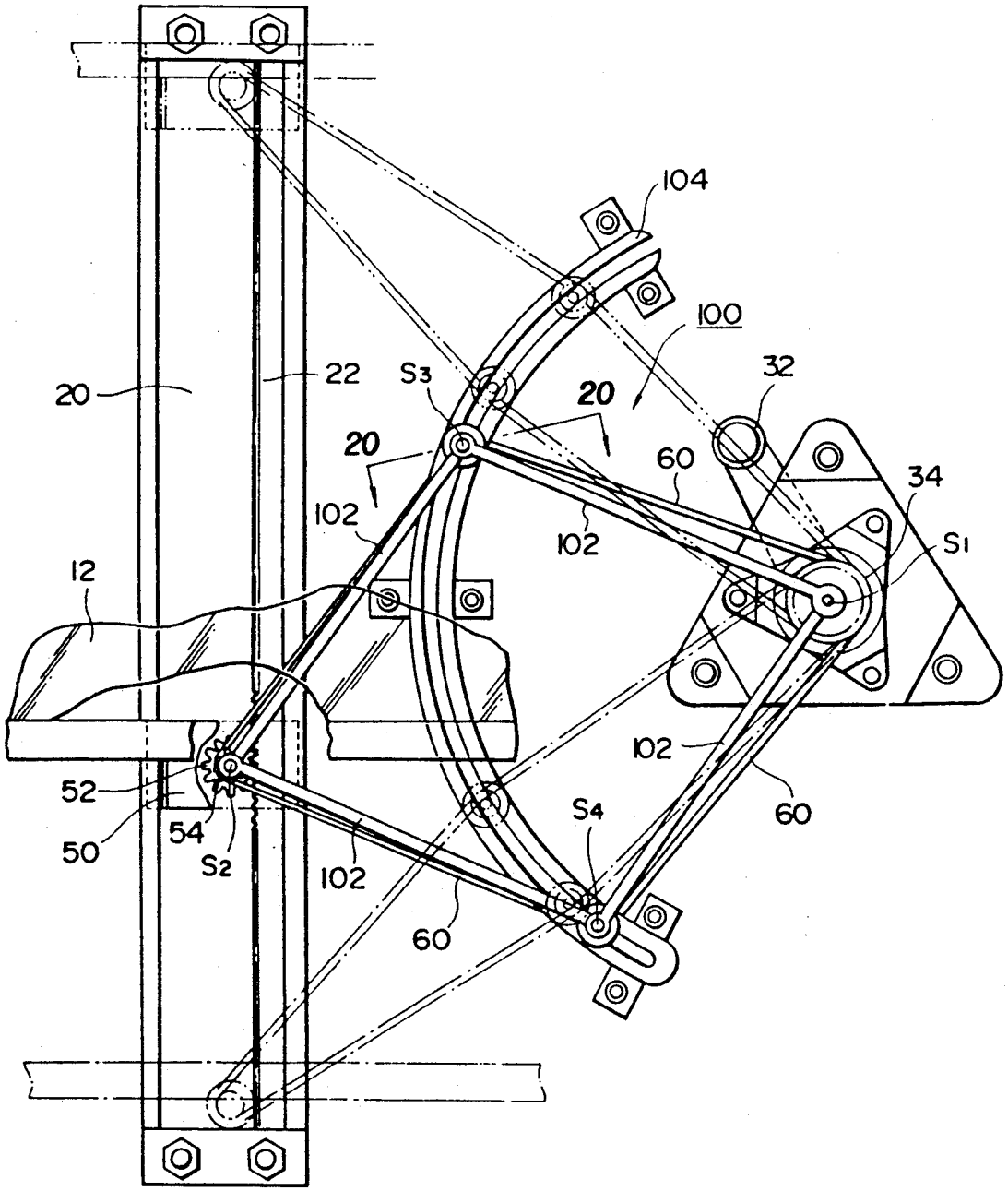
FIG. 19 is a schematic illustration of a fifth embodiment of the present invention showing an essential portion thereof in a cut away side elevation as viewed from the exterior of the automobile.

To this end, as shown in FIG. 19, the fifth embodiment employs a quadrilateral link mechanism 100 composed of four links 102 of equal length and pivotally connected at four points: namely, the axes $S_1$, $S_2$ of rotation of the drive and driven gears 34 and 54 respectively and points $S_3$ and $S_4$ which are slidable along an arcuate path which is centered at the axis of the drive gear 34. The tape 60 is wrapped around the apexes, i.e., four points $S_1$ to $S_4$, of the parallel link mechanism 100.

Figure 20:
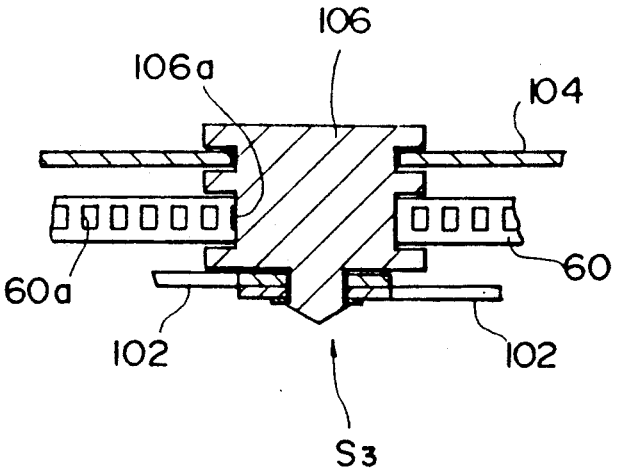
FIG. 20 is a sectional view taken along the line K-K of FIG. 19.

The above-mentioned arcuate path along which the pivot points $S_3$ and $S_4$ move is defined by an arcuate guide 104 which is centered at the axis $S_1$ of the drive gear 34. The connections of the links at the pivot points $S_3$ and $S_4$ movable along the guide 104 have an identical construction. For instance, as shown in FIG. 20, the pivotal connection at the point $S_3$ has a slider 106 movable along the guide 104 and having a cylindrical surface 106*a* capable of guiding the tape 60, the slider 106 having a boss or shaft portion to which adjacent ends of the links 102 and 102 are pivotally connected.

In the operation of the fifth embodiment, a vertical movement of the driven gear 54 effected by the operation of the handle 32 causes the pivot connections $S_3$ and $S_4$ to slide along the guide 104. Since the pivot points $S_1$ to $S_4$ are connected through links 102 of equal length, these pivot points are moved while changing the angles formed between the respective adjacent links 102 in such a manner that the respective pairs of opposing links 102, 102 are always maintained in parallel with each other. In addition, the links 102 made of a rigid material do not change their length. In consequence, the circumferential length of the path of the loop-like or endless tape 60 determined by the four apexes or pivot points $S_1$ to $S_4$ is maintained unchanged, whereby the tape 60 is kept in engagement with the drive and the driven gears 34 and 54 with a constant tension applied thereto.

As in the case of the third and the fourth embodiments, the fifth embodiment employs a clutch mechanism 70 which is incorporated in the gear box 50 or in the handle device 30, so as to prevent the door glass 12 from being moved up and down by manual force directly exerted on the glass.

Although the invention has been described through its preferred forms, it is to be noted that the described embodiments are only illustrative and various changes and modifications may be imparted thereto without departing from the scope of the invention.

For instance, although the described embodiments employ a combination of a perforated tape 60 and gears 34, 54 having teeth engageable with the perforations of the tape 60, various combinations of the driving and driven rotary members and the rotation transmission member drivingly connected therebetween may be employed, such as a combination of a cogged belt or timing belt and pulleys with grooves, provided that such a combination can smoothly transmit the rotational force without any slipping.

It is also to be noted that the manual window regulator of the present invention is applicable not only to a door with a frame as illustrated but also to a frameless door.

Furthermore, the manual window regulator of the present invention can be applied to various types of windows, even though a door window has been specifically mentioned in the preferred embodiment.

What is claimed is:

1. A manual window regulator for driving a window glass by a manual rotational force exerted on a handle to thereby open and close a window, comprising:

a rack fixed to extend in the direction of movement of said window glass;

a pinion rotatably carried by said window glass and held in meshing engagement with said rack;

driving means rotatable in accordance with the rotation of said handle;

driven means rotatable as a unit with said pinion;

loop-type transmission means for transmitting the rotation of said driving means to said driven means;

guide means for guiding said pinion to enable said pinion to move along said rack in meshing engagement with said rack; and a clutch for preventing said window glass from being driven by a force which is generated by means other than said handle, while allowing said window glass to move in response to a force which is produced by the rotation of said handle, wherein said clutch is disposed to act between said pinion and said driven means.

2. A manual window regulator according to claim 1, wherein said pinion is rotatably supported by a supporting member fixed to said window glass, and said guide means guides said supporting member such that said pinion rolls along said rack in meshing engagement therewith.

3. A manual window regulator according to claim 1, wherein said window regulator is disposed between an inner panel and an outer panel of a door of a vehicle, and said handle is provided on a side of said inner panel facing a passenger's compartment of said vehicle so that said window regulator can be manually operated from the interior of said compartment so as to drive said window glass.

4. A manual window regulator according to claim 1, wherein said driving means and driven means include respective gears, and said transmission means includes a loop-type member which drivingly engages with said gears.

5. A manual window regulator for driving a window glass by a manual rotational force exerted on a handle to thereby open and close a window, comprising:

a rack fixed to extend in the direction of movement of said window glass;

a pinion rotatably carried by said window glass and held in meshing engagement with said rack;

driving means rotatable in accordance with the rotation of said handle;

driven means rotatable as a unit with said pinion;

pulleys rotatably supported on portions of said rack near both ends thereof;

loop-type transmission means including an endless loop wrapped triangularly around said driving means, said pulleys and said driven means, and tensioned by said wrapping, said transmission means transmitting the rotation of said driving means to said driven means and preventing loosening of the endless loop; and guide means for guiding said pinion to enable said pinion to move along said rack in meshing engagement with said rack.

6. A manual window regulator according to claim 5, wherein said pinion is rotatably supported by a supporting member fixed to said window glass, and said guide means guides said supporting member such that said pinion rolls along said rack in meshing engagement therewith.

7. A manual window regulator according to claim 5, further comprising a clutch disposed to act between said handle and said driving means and capable of preventing said window glass from being driven by a force which is generated by means other than said handle while allowing said window glass to move in response to force which is produced by the rotation of said handle.

8. A manual window regulator according to claim 5, wherein said driving means is unitarily provided with said guide means.

9. A manual window regulator according to claim 5, wherein said driving means and driven means include respective gears and said transmission means includes a loop-type transmission member which drivingly engages with said gears, said manual window regulator further comprising guide means for preventing said loop-type transmission member from coming off said gear of said driven means.

10. A manual window regulator according to claim 5, wherein said guide means is provided on a rack bracket to which said rack is fixed and said driving means is rotatably supported by a supporting member which is integrally connected to said rack bracket.

11. A manual window regulator for driving a window glass by a manual rotational force exerted on a handle to thereby open and close a window, comprising:

a rack fixed to extend in the direction of movement of said window glass;

a pinion rotatably carried by said window glass and held in meshing engagement with said rack;

driving means rotatable in accordance with the rotation of said handle;

driven means rotatable as a unit with said pinion;

loop-type transmission means wrapped around said driving means and said driven means for transmitting the rotation of said driving means to said driven means;

guide means for guiding said pinion to enable said pinion to move along said rack in meshing engagement with said rack;

slack prevention means for preventing said transmission means from slackening due to a change in the distance between said driving means and said driven means; and a clutch disposed to act between said pinion and said driven means and capable of preventing said window glass from being driven by a force which is generated by means other than said handle while allowing said window glass to move in response to a force which is produced by the rotation of said handle.

12. A manual window regulator according to claim 11, wherein said pinion is rotatably supported by a supporting member fixed to said window glass, and said guide means guides said supporting member such that said pinion rolls along said rack in meshing engagement therewith.

13. A manual window regulator according to claim 11, wherein said window regulator is disposed between an inner panel and an outer panel of a door of a vehicle, and said handle is provided on a side of said inner panel facing a paseenger's compartment of said vehicle so that said window regulator is manually operated from the interior of said compartment so as to drive said window glass.

14. A manual window regulator according to claim 11, wherein said driving means and driven means include respective gears and said transmission means includes a loop-type transmission member which drivingly engages with said gears, said manual window regulator further comprising guide means for preventing said loop-type transmission member from coming off said gear of said driven means.

15. A manual window regulator according to claim 11, wherein said slack prevention means includes spring means capable of drawing the portions of said transmission means extending between said driving means and said driven means towards each other.

16. A manual window regulator according to claim 11, wherein said slack prevention means includes a quadrilateral link mechanism composed of a first pair of links pivotable around the center of said driving means and a second pair of links pivotable around the center of said driven means and pivotally connected to said first pair of links, and wherein said transmission means includes being wrapped around the two pivotal connections between said frist and second pair of links.

* * * * *